US007000794B2

(12) United States Patent
Soehnlen et al.

(10) Patent No.: US 7,000,794 B2
(45) Date of Patent: Feb. 21, 2006

(54) INCREASED RESERVOIR FOR FLUID CONTAINER

(75) Inventors: Daniel P. Soehnlen, Canton, OH (US); Gregory M. Soehnlen, N. Canton, OH (US)

(73) Assignee: Creative Edge Design Group, Ltd., Canton, OH (US)

( * ) Notice: Subject to any disclaimer, the term of this patent is extended or adjusted under 35 U.S.C. 154(b) by 106 days.

(21) Appl. No.: 10/386,338

(22) Filed: Mar. 11, 2003

(65) Prior Publication Data

US 2004/0007488 A1 Jan. 15, 2004

Related U.S. Application Data

(60) Continuation-in-part of application No. 10/264,305, filed on Oct. 3, 2002, which is a continuation of application No. 09/472,138, filed on Dec. 23, 1999, now Pat. No. 6,591,986, which is a division of application No. 09/114,244, filed on Jun. 29, 1998, now Pat. No. 6,068,161.

(60) Provisional application No. 60/052,775, filed on Jul. 1, 1997.

(51) Int. Cl.
*B65D 1/18* (2006.01)
*B65D 23/10* (2006.01)

(52) U.S. Cl. ..... 215/398; 215/10; 215/382; 220/669; 220/675; 220/771

(58) Field of Classification Search ..... 215/10, 215/382, 398, 396, 381, 383, 902; 220/23.6, 220/771, 669, 675; 206/431, 434, 503
See application file for complete search history.

(56) References Cited

U.S. PATENT DOCUMENTS

| | | | | |
|---|---|---|---|---|
| 3,746,200 | A * | 7/1973 | Flider | 215/10 |
| 4,351,454 | A * | 9/1982 | Maynard, Jr. | 222/143 |
| 4,541,529 | A * | 9/1985 | Hestehave et al. | 206/510 |
| 4,579,260 | A * | 4/1986 | Young et al. | 222/465.1 |
| 4,609,106 | A * | 9/1986 | Gentili | 206/509 |
| 4,889,261 | A * | 12/1989 | Conrad | 222/130 |
| 5,265,743 | A * | 11/1993 | Frohn | 215/10 |
| 5,299,710 | A * | 4/1994 | Welsch et al. | 220/675 |
| 5,305,910 | A * | 4/1994 | Pollacco | 220/771 |
| 5,779,051 | A * | 7/1998 | Boutin | 206/504 |
| 6,050,455 | A | 4/2000 | Soehnlen et al. | |
| 6,068,161 | A | 5/2000 | Soehnlen et al. | |
| 6,247,507 | B1 | 6/2001 | Soehnlen et al. | |
| 2003/0132184 | A1 * | 7/2003 | Dorn et al. | |

FOREIGN PATENT DOCUMENTS

| | | | |
|---|---|---|---|
| AU | 32326 | * | 5/1999 |
| EP | 0274742 A1 | * | 7/1988 |
| EP | 0457121 A1 | * | 11/1991 |
| JP | 10230980 A | * | 9/1998 |
| WO | WO 99/11524 | * | 3/1999 |

* cited by examiner

*Primary Examiner*—Sue A. Weaver
(74) *Attorney, Agent, or Firm*—Fay, Sharpe, Fagan, Minnich & McKee, LLP

(57) ABSTRACT

A container for storing a fluid incorporates an overflow region. The overflow region is located above the desired fill line of the container and preferably terminates in the same plane as the opening of the fill spout. In this manner, the amount of fluid filled in the container can be maximized while still providing the desired air space for shipping purposes. Incorporating structural features into the body of the blow-molded container eliminate the use of external cases.

17 Claims, 3 Drawing Sheets

INCREASED RESERVOIR FOR FLUID CONTAINER

This application hereby incorporates by reference the following chain of applications/patents and claims the priority benefit of continuation-in-part application of application Ser. No. 10/264,305, filed Oct. 3, 2002, which is a continuation of application Ser. No. 09/472,138, filed Dec. 23, 1999, now U.S. Pat. No. 6,591,986, which is a divisional of application Ser. No. 09/114,244, filed Jun. 29,1998, now U.S. Pat. No. 6,068,161, which claims benefit of provisional application Ser. No. 60/052,775, filed Jul. 1, 1997.

BACKGROUND OF INVENTION

The present invention relates generally to receptacles and containers, and particularly relates to a caseless dispenser container used for transporting, storing, and dispensing fluids. The invention finds particularly particular application with fluids introduced or subjected to elevated temperatures relative to the filling temperature of the fluid into the container, such as cooking oil or similar comestible products, although it may also find application with noncomestible fluid products.

U.S. Pat. Nos. 6,050,455; 6,068,161; and 6,247,507 are commonly owned by the assignee of the present application. These patents relate generally and specifically to the concept of thin-walled containers, and the disclosures of each are hereby expressly incorporated herein. For example, thin-walled containers which are defined as having a ratio of plastic resin required to manufacture the container relative to the amount of product capable of being transported in the container. A typical thin-walled container of this type has a weight-to-volume ratio of approximately 55 to 70 grams per gallon (approximately 18 to 24 grams per liter).

In shipping and storing bulk fluid products, plastic molded containers are commonly used and are blow-molded, one-piece containers. These containers are usually stored or shipped in a separate case that receives individual containers or may enclose multiple containers such as a set of four (4) to six (6) containers. These cases adopt various different configurations or conformations such as wire or plastic cases, corrugated paper boxes, or other corrugated materials, which provide desired structural support to the individual containers during shipping. For example, and as shown in FIG. 1, a blow-molded plastic container is received in a corrugated box for storage, shipment, and handling. Since the corrugated case is intended to carry or receive the structural load or bearing forces during storage and shipment, little design effort has heretofore been undertaken to address structural concerns of a container without the use of separate cases, i.e., caseless shipping containers.

Another common use for containers in cases is to store and ship cooking oil. Historically, and as briefly noted above, these containers are used in conjunction with a corrugated or cardboard case so that vertical loading of one container to the other is transferred through the cases. As will be appreciated, part of the manufacturing/total cost of the shipping assembly is associated with the corrugated case. The use of the case allows less resin to be used in the plastic container, although the design of the assembly (container and associated case) is intended to transfer structural forces via the corrugated material and not the container.

These known arrangements encounter a number of problems, for example, stacking height of one container on top of another is limited. Long, unbraced lengths are encountered. In addition, if the corrugated material becomes wet, e.g., if a container leaks or moisture from the environment permeates the corrugated case, the structural strength and integrity of the corrugated case can become a serious problem. There are also potential food storage issues associated with any leakage of oil.

Still another issue with a container and case assembly used in storing and shipping cooking oil, for example, is that the oil is typically filled at a temperature above ambient, on the order of approximately one hundred degrees Fahrenheit (100° F.). Oil is less dense at the elevated temperature. The containers are usually filled to the base of the neck and then over time and as the oil cools, the fill level decreases. This results in a large air gap in prior art containers. In order to ship a desired amount of oil when it is filled at an elevated temperature, the vendor must use a container of increased height to accommodate this phenomenon.

Once the container is filled, it is sealed with a cap, such as a screw-on or threaded cap. Typically, a lesser quality, less expensive model is used since some of the cost in the prior art arrangements is directed to supplying the corrugated case. If the sealed container is exposed to an increase in temperature, for example on the order of one hundred ten degrees (110° F.) while sitting in a truck in a hot environment, the increase in internal pressure could cause the lesser quality cap to leak. As will be appreciated, this only exacerbates the situation of contaminated product, as well as moisture problems and decreased strength associated with the prior art corrugated case and container assembly.

Accordingly, a need exists to provide a container, preferably a caseless container that resolves these problems and others in an inexpensive, efficient, and reliable manner.

BRIEF SUMMARY OF INVENTION

A new and improved container for storing fluid, particularly a fluid filled at an elevated temperature, and a method of forming same is provided.

In an exemplary embodiment of the invention, the container includes a generally parallelepiped structure having a fill/dispensing spout through one wall thereof. The spout extends above a desired fill level with an opening that terminates in a first plane. An overflow region is provided that terminates in a wall portion in the first surface that is disposed between the fill level and first plane to accommodate a desired air space in the container.

Preferably, a wall portion defining the overflow region terminates substantially in the same plane as the opening through the spout.

A handle is preferably interposed between the opening and the wall portion of the overflow region. In one embodiment, the handle extends at an angle from beneath a base portion of the spout to the wall portion of the overflow region.

With large volume containers that may hold three (3) to five (5) gallons of a fluid, product may be stored in caseless containers. A number of structural load elements, which in the preferred arrangement are rib elements, are used to add structural rigidity to the container. The larger containers may be stacked in a brick-like fashion.

Preferably, the ribs are oriented generally perpendicular to the elongated dimension of the container to serve the useful purpose of transferring forces from an upper layer to a lower layer of containers when the containers are oriented in a stacked array on their sides.

An advantage of the present invention resides in the ability of the container to accommodate fluid filled at an elevated temperature.

Still another advantage is found in the elimination of cases for shipping.

Yet another advantage is found in improved sealing of the spout.

Still other advantages and benefits of the present invention will become apparent to those skilled in the art upon reading and understanding the following detailed description.

DETAILED DESCRIPTION OF THE INVENTION

Figure 1:
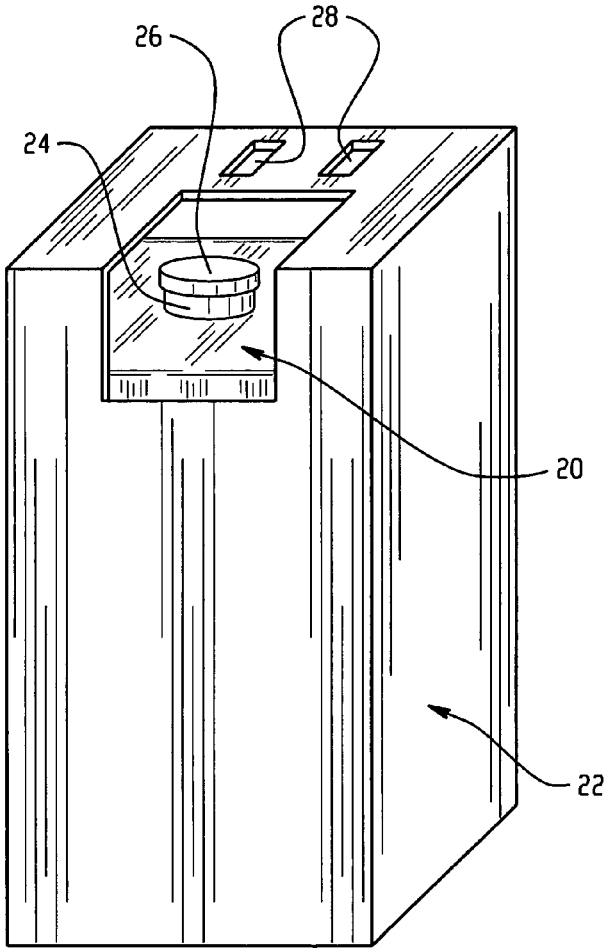
Fig. 1 PRIOR ART
FIG. 1 is an isometric view of a prior art container stored in a corrugated case.
Figure 4:
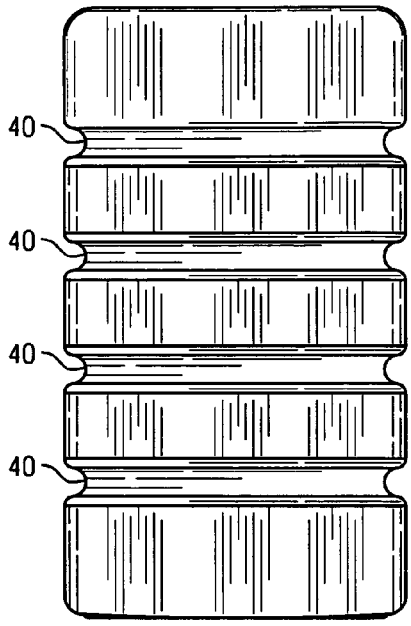
FIGS. 2–6 are elevational, right side, left side, top, and bottom plan views of a preferred embodiment of the invention.

Briefly, and with reference to FIG. 1, a prior art arrangement of a thin-walled bottle or container 20 is shown in a corrugated case 22. The container includes a fluid spout 24 having a cap 26 intended to seal a fluid spout opening (not shown). The spout in this embodiment is intended to be used for both filling and dispensing, and thus is generally a wide-mouthed opening to facilitate the amount of fluid that is filled or dispensed from the container. Cutouts 28 are provided in an upper surface of the corrugated case 22 to form a handle for lifting and transport of the combined case and container assembly. Again, this assembly is a conventional arrangement and illustrates how some bulk fluids, such as cooking oil or the like, are stored and shipped through commerce.

FIGS. 2–6 illustrate a preferred container 30 for storing fluids in accordance with the present invention, and in this particular instance illustrates a caseless container that solves a particular need with regard to a fluid filled in the container at an elevated temperature. The bottle or container 30 is preferably a one-piece, blow-molded plastic construction which has a generally parallelepiped wall structure 32 integrally formed in the blow-molding process and having a fluid spout 34 and integral handle 36 formed therein. The container is a hollow structure forming an internal cavity that is dimensioned to receive a predetermined quantity of fluid therein, for example, two or five gallon containers, although other sizes are also contemplated without departing from the scope and intent of the present invention. Dairy products, juices, cooking oil, and other comestible fluid products, or powder or liquid detergents may be stored therein. Thus, continued reference to the particular application of this structure for cooking oil should not be deemed limiting, even though the container described herein serves the particular needs required in that industry.

The wall structure includes a strengthening component such as a series of integrally formed ribs or grooves 40 that provide additional structural strength or rigidity to the container. As shown, the strengthening features 40 are illustrated as extending around the entire periphery of the container and are disposed in generally parallel relation to a first or upper surface 42 and a second or lower surface 44. Although it will be appreciated that the strengthening features 40 are peripherally continuous in the illustrated embodiment, related designs that alter the cross-section of these ribs in order to attain increased rigidity or strength can be used without departing from the present invention.

Figure 5:
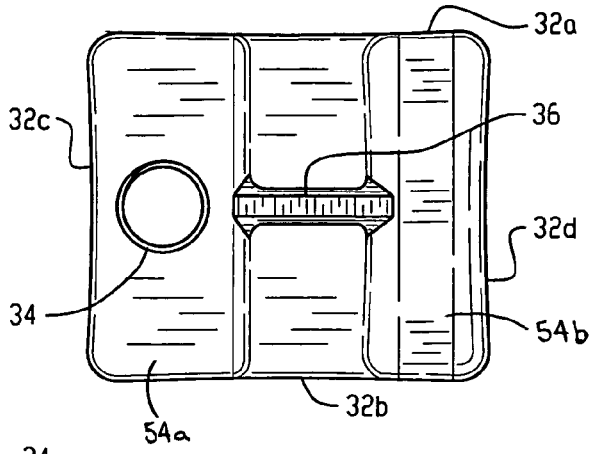
Figure 3:
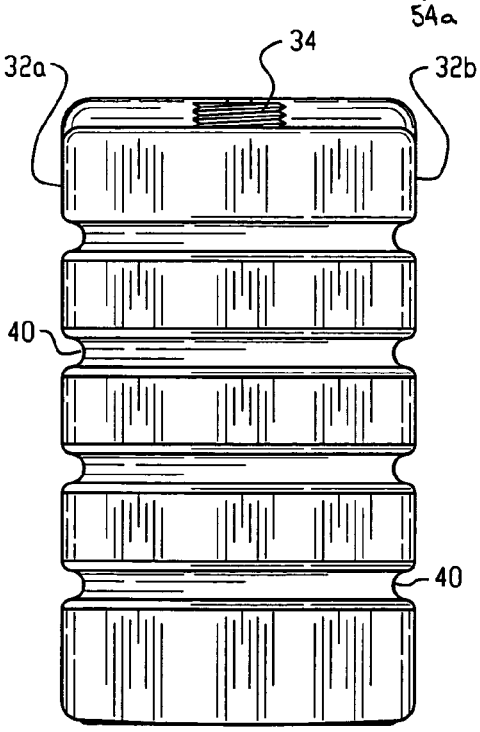
Figure 2:
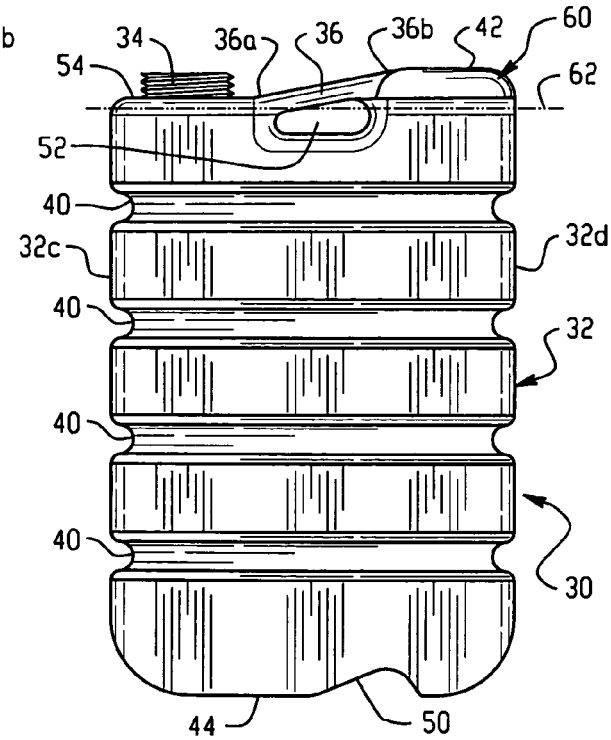
Figure 6:
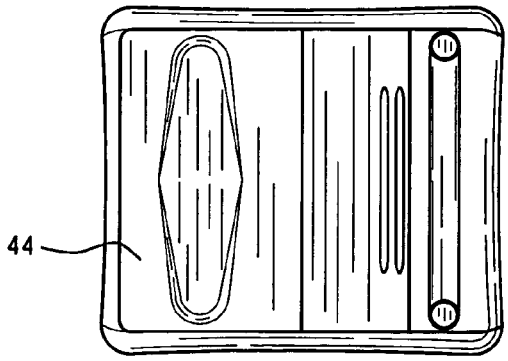

The lower surface 44 includes a recess 50 that is primarily intended for ease of handling when the contents of the fluid container are poured from the spout. As will be further appreciated, a user grasps the container by the handle 36 with one hand and can tip or manipulate the container by placing the fingers of the other hand into the recess 50 on the lower surface. The contents can then be poured from the container in a controlled fashion. It will also be appreciated that opening 52 is provided to form/delineate the handle from the remainder of the container and allows the container to be lifted with a single hand. If the lateral width of the handle is increased, it may not be necessary to provide a through opening cooking oil, and instead recesses extending inwardly from either side may be sufficient. The handle is preferably centrally located between parallel sidewall portions 32*a*, 32*b* (FIGS. 3 and 5) and is also approximately disposed midway between front and rear wall portions 32*c* and 32*d* (FIGS. 2 and 5). This advantageously locates the handle behind the spout 34, which is located forwardly on a substantially planar portion 54 forming an upper surface of the wall structure of the container. In the preferred embodiment, the handle 36 integrally merges at one end 36*a* to provide a smooth transition with the upper surface portion 54 and at a second end 36*b* merges with an overflow reservoir region 60 the structure and function of which will be described in greater detail below. Although this handle arrangement has particular advantages, other handle configurations may prove useful for other or related applications.

The reservoir region comprises approximately one and one-half percent (1½%) of the total volume of the container. For example, in a thirty five (35) pound version of the container, the total fill capacity is approximately one thousand sixty five cubic inches (1,065 $in^3$) and the overflow region capacity is approximately twenty additional cubic inches (20 $in^3$), for a total of one thousand eighty four cubic inches (1,084 $in^3$). In the seventeen and one half (17½) pound version of the container, the total fill capacity is approximately five hundred and thirty two cubic inches (532 $in^3$) and the overflow region adds an additional eight cubic inches (8 $in^3$) of capacity for a total of five hundred forty cubic inches (540 $in^3$). The upper wall portion 54*b* in the overflow region defines the upper terminus of the container. That is, it defines a stepped region above the planar portion 54*a* of the upper surface located beneath the spout. The overflow region provides increased capacity that finds particular application when fluid, such as cooking oil, is introduced into the container at an elevated temperature. The fill line is represented by dotted line 62 (FIG. 2) and is just below the wall portion 54*a* beneath the spout. Here, however, the overflow region provides additional air space. If a fluid is filled at an elevated temperature, for example 100° F., with time it will cool and the fill level will decrease. Previously, manufacturers could only fill to a level below the representative fill line 62 because of the absence of any overflow region such as 60. That is, the fill level was substantially below the bottom of the spout, and then as it cooled over time, the fluid level would be substantially below the upper surface of the container. This was necessary in situations where the fluid was also raised to an even higher temperature, for example during storage the temperature in some environments can reach 110° F. or greater, resulting in increased pressure in the sealed container. The overflow region accommodates these conditions and allows increased volume or capacity of fluid to be filled into each container of a certain height. By forming the overflow region and the upper wall at substantially the same height as the opening of the spout (i.e., above the planar portion 54*a*, the fill level 62 can be increased to the adjacent bottom portion of the spout without filling all of the overflow region air space 60. Once the cap (not shown) is placed onto the container, the filled container becomes a sealed environment. For example, a cap incorporating a rubber gasket on the interior or underside surface of the cap provides an improved sealing arrangement. This is an improvement over the conventional foil type seal used in association with a lesser quality cap that does not have the ability to withstand the internal pressures encountered in some uses, such as with oil. Under increased temperature the prior art arrangements had a tendency to leak since part of the manufacturing cost was devoted to the purchase of a corrugated case rather than an improved cap-to-container seal. Here, eliminating the cases, and incorporating the overflow region and structural means to handle the increased internal pressure, provides a highly useful container that addresses these concerns while also addressing cost concerns associated with material purchase and manufacture of the container.

Figure 7:
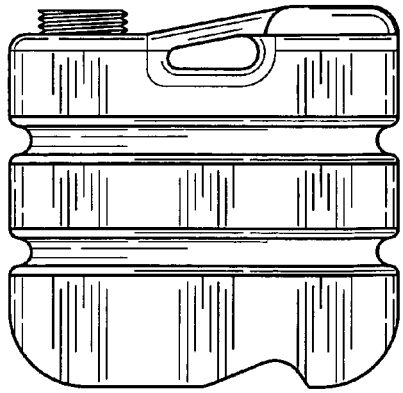
FIG. 7 is an elevational view of another embodiment of the invention.

As is also apparent in FIG. 7, the container can be made in various sizes. The seventeen and one half (17½) pound version shown in FIG. 7 is simply representative of one of a number of different sized containers that can be used incorporating these concepts. Like numbers represent like elements and the features and benefits described above in association with the embodiment of FIGS. 2–6 are also provided here.

Figure 8:
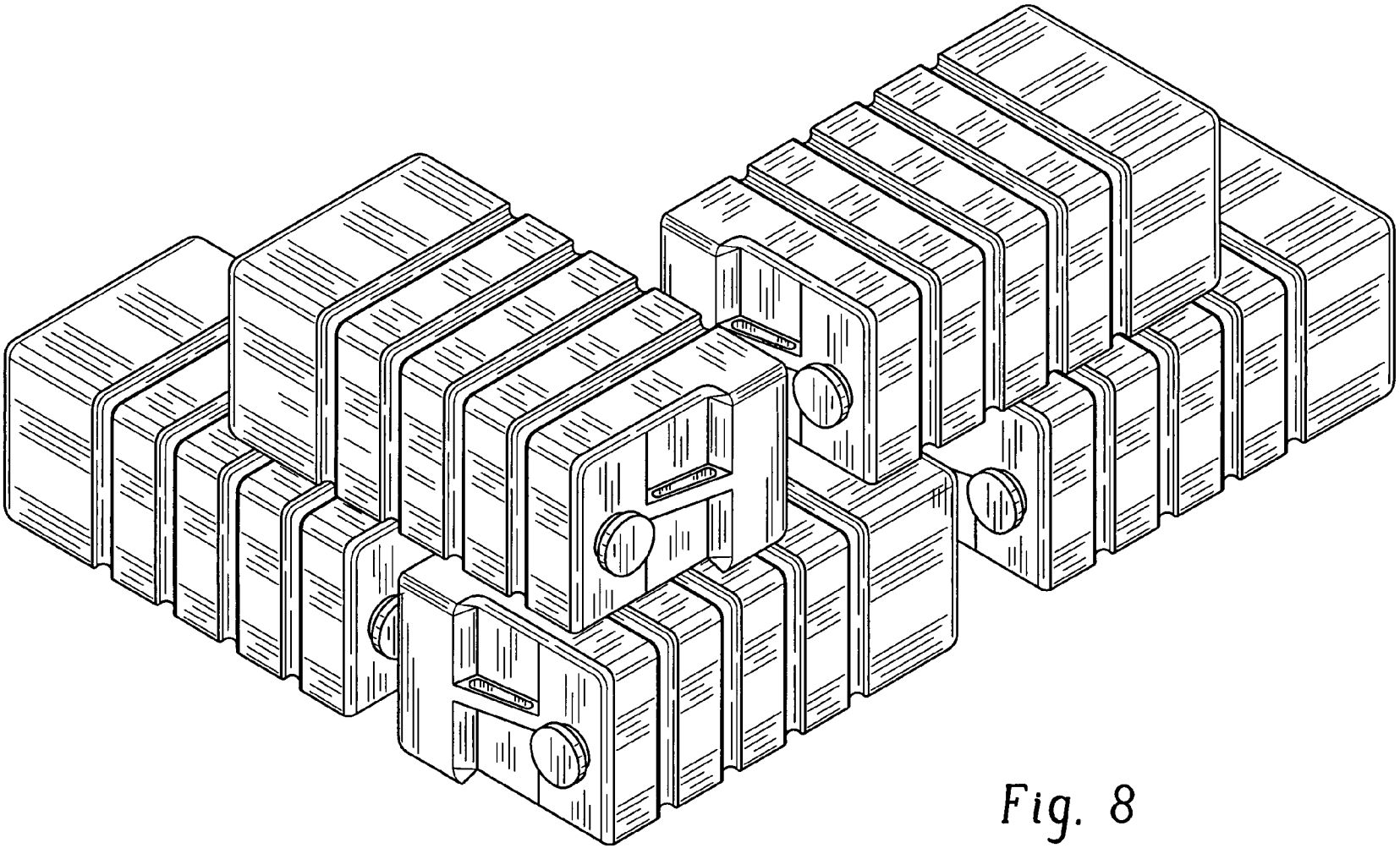
FIG. 8 is a representation of multiple containers stacked in accordance with the present invention.

FIG. 8 illustrates a desired stacking array of the filled containers. The strengthening ribs allow the manufacturer/shipper to eliminate the use of any external cases such as a corrugate case, and still can withstand loading forces and internal pressure when sealed that match or exceed that of the prior art. By stacking the containers on their side as illustrated in FIG. 8 in brick-like fashion, there are no long unbraced lengths. That is, the structural reinforcing ribs are able to transfer load from one upper layer to the next adjacent lower layer. As noted above, a higher quality, more expensive cap can be used in this arrangement. Moreover, by stacking the containers on their sides, the vertical loads need not necessarily be transferred through the cap and spout.

The container can be filled to increased capacity, and provision is made for filling with fluids at elevated temperatures, as well as encountering environments where the sealed container is exposed to elevated temperatures. The potential problems associated with a container that leaks are also substantially reduced since the structural load bearing capability of the container is not impacted.

The invention has been described with reference to the preferred embodiments. Obviously, modifications and alterations will occur to others upon a reading and understanding of this specification. It is intended that the invention be construed as including all such modifications and alterations insofar as they come within the scope of the appended claims or the equivalents thereof.

What is claimed is:

1. A container for storing fluid that is filled therein, the container comprising:

a generally parallelepiped wall structure enclosing an internal cavity dimensioned to receive an associated fluid therein, the wall structure including a first surface having first and second wall portions, the second wall portion being located above the first wall portion;

a recess interposed between the first wall portion and the second wall portion; and means for providing an overflow region in the container, the overflow region providing means including:

the first wall portion located adjacent a desired fill level of the container and having a fluid spout extending outwardly from the first wall portion and the desired fill level with an opening that terminates in a first plane, and a ventless overflow region of the cavity that terminates in the second wall portion that is disposed between the fill level and first plane, a plane of the second wall portion being substantially parallel to first plane, the overflow region accommodates a desired air space in the container wherein the associated fluid filled at an elevated temperature relative to a storage and shipping temperature into the internal cavity via the opening can migrate into the overflow region thereby increasing the volume of the associated fluid being stored at the storage and shipping temperature.

2. The container of claim 1 wherein the wall portion of the overflow region terminates substantially in the first plane.

3. The container of claim 1 further comprising a handle interposed between the opening and the wall portion of the overflow region.

4. The container of claim 3 wherein the handle angles from a first end located beneath the opening and the wall portion of the overflow region.

5. The container of claim 1 further comprising a handle interposed between the opening and the wall portion of the overflow region, the handle located substantially midway between opposed sidewall portions of the wall structure.

6. The container of claim 5 wherein the handle is located substantially midway between front and rear wall portions of the wall structure.

7. The container of claim 6 wherein the handle angles from a first end located beneath the opening and the wall portion of the overflow region, and the fluid spout and overflow region are separated by the recess.

8. The container of claim 1 wherein the recess is located on an opposite side of the fill level from the fluid spout and the wall portion of the overflow region.

9. The container of claim 1 further comprising a handle having first and second ends, wherein the first surface includes a substantially planar neck region from which the fluid spout extends outwardly, and the first end of the handle terminates into the substantially planar neck region.

10. The container of claim 9 wherein the second end of the handle terminates into the wall portion of the overflow region.

11. The container of claim 1 wherein the container further comprises corrugations in the wall structure for adding strength thereto.

12. The container of claim 11 wherein the corrugations are substantially parallel to one another.

13. The container of claim 12 wherein the corrugations are substantially parallel to the first plane.

14. The container of claim 1 wherein the recess is interposed between the fluid spout and the overflow region, the recess being substantially below the first plane.

15. The container of claim 14 further comprising a handle that overlies the recess and interconnects the fluid spout and the overflow region.

16. The container of claim 1 wherein the overflow region is approximately 1.5% of the total volume of the container internal cavity.

17. A container for storing fluid that is filled therein at an elevated temperature, the container comprising:

a generally parallelepiped wall structure enclosing an internal cavity dimensioned to receive an associated fluid therein, the wall structure including corrugations for adding strength thereto;

a first surface of the wall structure located adjacent a desired fill level of the container and having a fluid spout extending outwardly from the first surface and the desired fill level with an opening that terminates in a first plane, and a ventless overflow region of the cavity that terminates in a wall portion in the first surface that is disposed between the fill level and the first plane whereby the overflow region accommodates a desired air space in the container and is approximately 1.5% of the total volume of the container internal cavity.

* * * * *